US008915522B2

(12) United States Patent
Roiser

(10) Patent No.: US 8,915,522 B2
(45) Date of Patent: Dec. 23, 2014

(54) POLE WITH GRIP

(71) Applicant: Komperdell Sportartikel Gesellschaft m.b.H., Mondsee (AT)

(72) Inventor: Thomas Roiser, Mondsee (AT)

(73) Assignee: Komperdell Sportartikel Gesellschaft m.b.H., Mondsee (AT)

( * ) Notice: Subject to any disclaimer, the term of this patent is extended or adjusted under 35 U.S.C. 154(b) by 0 days.

(21) Appl. No.: 13/681,757

(22) Filed: Nov. 20, 2012

(65) Prior Publication Data

US 2013/0140803 A1 Jun. 6, 2013

(30) Foreign Application Priority Data

Dec. 1, 2011 (AT) ..... GM653/2011

(51) Int. Cl.
*A63C 11/00* (2006.01)
*A45B 9/02* (2006.01)
*A63C 11/22* (2006.01)

(52) U.S. Cl.
CPC ..... *A63C 11/222* (2013.01); *A45B 9/02* (2013.01)
USPC ..... 280/821; 280/819; 280/820; 280/822

(58) Field of Classification Search
CPC ..... A63C 11/00; A63C 11/22
USPC ..... 280/821, 819, 820, 822
See application file for complete search history.

(56) References Cited

U.S. PATENT DOCUMENTS

| | | | | | |
|---|---|---|---|---|---|
| 3,297,333 | A * | 1/1967 | Schwedt et al. | ..... | 280/820 |
| 3,540,751 | A * | 11/1970 | Pierce | ..... | 280/822 |
| 3,687,472 | A * | 8/1972 | Struble, Jr. | ..... | 280/821 |
| 3,797,845 | A * | 3/1974 | Kepka et al. | ..... | 280/822 |
| 3,899,904 | A * | 8/1975 | Brimhall, II | ..... | 280/821 |
| 3,982,747 | A * | 9/1976 | Schweinsberg | ..... | 280/822 |
| 4,247,132 | A | 1/1981 | Shields | | |
| 4,288,100 | A * | 9/1981 | Aho | ..... | 280/821 |
| 4,288,101 | A * | 9/1981 | Aho | ..... | 280/821 |
| 6,311,370 | B1 * | 11/2001 | Blin | ..... | 280/821 |
| 6,851,437 | B1 * | 2/2005 | Lenhart | ..... | 280/821 |
| 7,621,564 | B2 * | 11/2009 | Lenhart | ..... | 280/821 |

FOREIGN PATENT DOCUMENTS

| | | | |
|---|---|---|---|
| CH | 195360 | A | 4/1938 |
| EP | 1736214 | A1 | 12/2006 |
| FR | 2418660 | A1 | 9/1979 |

OTHER PUBLICATIONS

Austrian Search Report, from corresponding AT application.

* cited by examiner

*Primary Examiner* — Hau Phan
(74) *Attorney, Agent, or Firm* — Young & Thompson

(57) ABSTRACT

A loop (5) is attached to a grip (1) of a pole using a ball and socket joint. The ball and socket joint encompasses a ball (7) that is held with the capacity to turn and pivot in a recess (8) in the head (4) of the grip (1).

11 Claims, 3 Drawing Sheets

POLE WITH GRIP

The invention relates to a pole, especially a pole with a grip, especially a sports pole with a grip, with a loop attached to the pole, especially to its grip or in its grip region.

Known sports poles, especially poles that are used for alpine skiing, cross country skiing, Nordic walking or for hiking, have a loop that is conventionally connected to the pole on the head of the grip.

In the known poles, the loop is rigidly attached and the mobility of the loop is due solely to the deformability of the material from which the loop is made.

However, often more extensive mobility of the loop relative to the pole or its grip, or grip region, is desired.

The object of the invention is to make available a pole of the initially named type in which there is greater mobility of the loop.

This object is achieved according to the invention with a pole that has the features of Claim 1.

Preferred and advantageous embodiments of the pole according to the invention are the subject matter of the dependent claims.

Since in the pole according to the invention, a loop is attached in an articulated manner to the pole, for example to its grip, it is possible for the loop to be moved independently of the material of which it is comprised, relative to the pole.

Especially when the articulation, via which the loop is connected to the pole, is a ball and socket joint, there is not only freedom of movement of the loop in the vertical direction, (i.e., it can be pivoted up and down relative to the pole), but the loop can also turn around the axis of the pole.

In one preferred embodiment of the invention, it is provided that the ball of the ball and socket joint is held with the capacity to turn freely or to a limited degree in a recess of the pole, for example of its grip.

If it is desired to limit the extent of movement of the loop relative to the pole, there can be projections (stops) on the ball that limit the pivoting relative to the pole or its grip to the desired degree. The pivoting range can be determined by the location of the projections on the ball.

In addition or alternatively, it can be provided that the turning capacity of the ball is limited. This can be achieved by there being in the ball a depression that a projection engages, for example a pin that is fixed to the pole, for example its grip, so that the mobility of the ball is limited by the projection (pin) striking the edge of the depression in the ball. The size, location and shape of the depression and/or the size of the projection can define the region in which the ball and thus the loop can be pivoted/turned.

Other details and features of the invention will become apparent from the following description of preferred exemplary embodiments of grips for a pole according to the invention using the drawings. Here:

Figure 1:
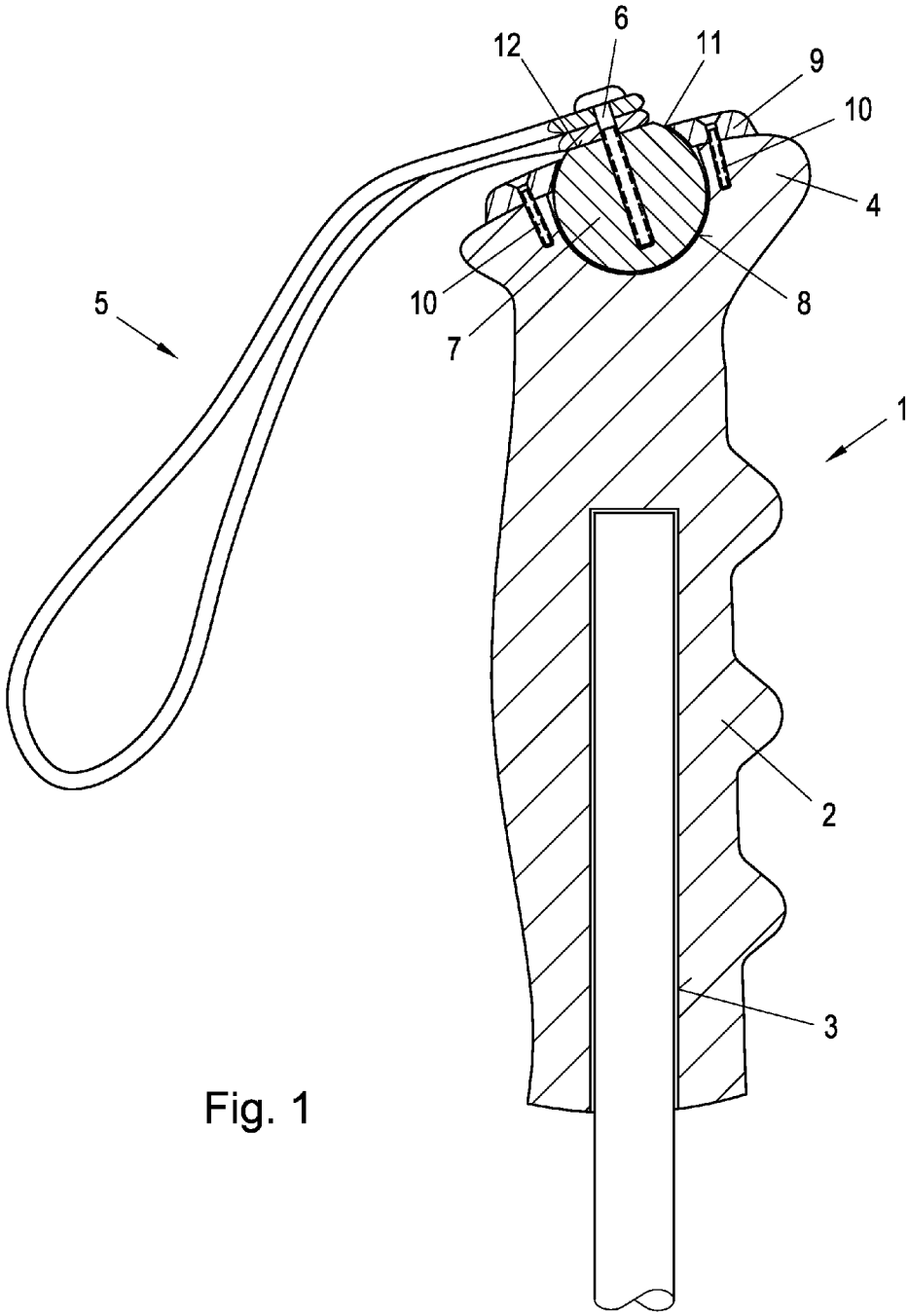
FIG. 1 shows a first embodiment in a section.

A pole according to the invention has a grip 1 with a grip part 2, in which there is a blind hole 3 for accommodating a pole tube or a pole rod. Furthermore, the grip 1 has a head 4, to which a loop 5 is attached in a manner that is still to be described.

The loop 5 can be a loop of a belt (optionally with changing width), of a cord or of another elongated part.

In the exemplary embodiment shown in FIG. 1, the loop 5 is attached in an articulated manner to the grip 1, especially its head 4. The articulated attachment of the loop 5 to the grip 1 is achieved by the loop 5 being attached in any manner—in the illustrated embodiment using a screw 6—to a ball 7.

The ball 7 is accommodated to be able to turn freely in a recess 8 in the head 4 of the grip 1. Here, the ball 7 is held in the recess 8 by a cover plate 9. The cover plate 9 is attached in any manner to the head 4 of the grip 1. The attachment can take place as shown in FIG. 1 using screws 10. It is also possible, however, to attach the cover plate 9 to the head 4 of the grip 1 by cementing, welding-on or by the cover plate 9 being inserted into a depression that is provided around the mouth of the recess 8 and to fasten it there by latching or screwing it in (in this case, the cover plate 9 on its outside has a thread and the edge of the depression in the head 4 has an inner thread).

In the cover plate 9, there is a recess (hole) 11 through which the ball 7 projects to the outside with a flattening 12. FIG. 1 shows that the loop 5 is fastened with the screw 6 in the region of the flattening 12 of the ball 7.

The edge of the hole 11 in the cover plate 9 is made conically tapering upward (away from the grip 1) and has especially the shape of an annular spherical surface, the radius being matched to the radius of the ball 7. In this way, reliable guidance of the ball 7 is ensured.

Figure 2:
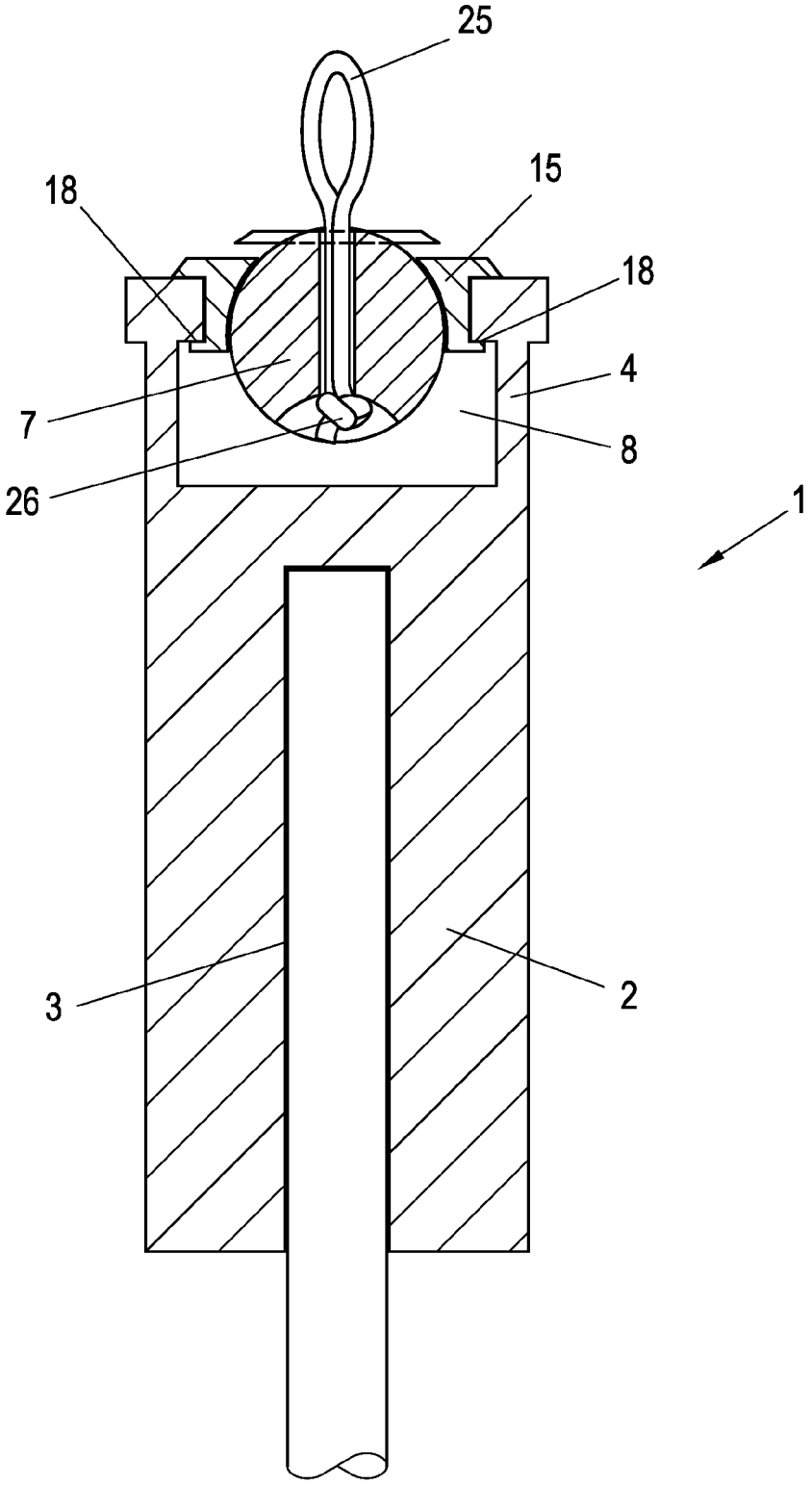
FIG. 2 shows a second embodiment in a section.
Figure 3:
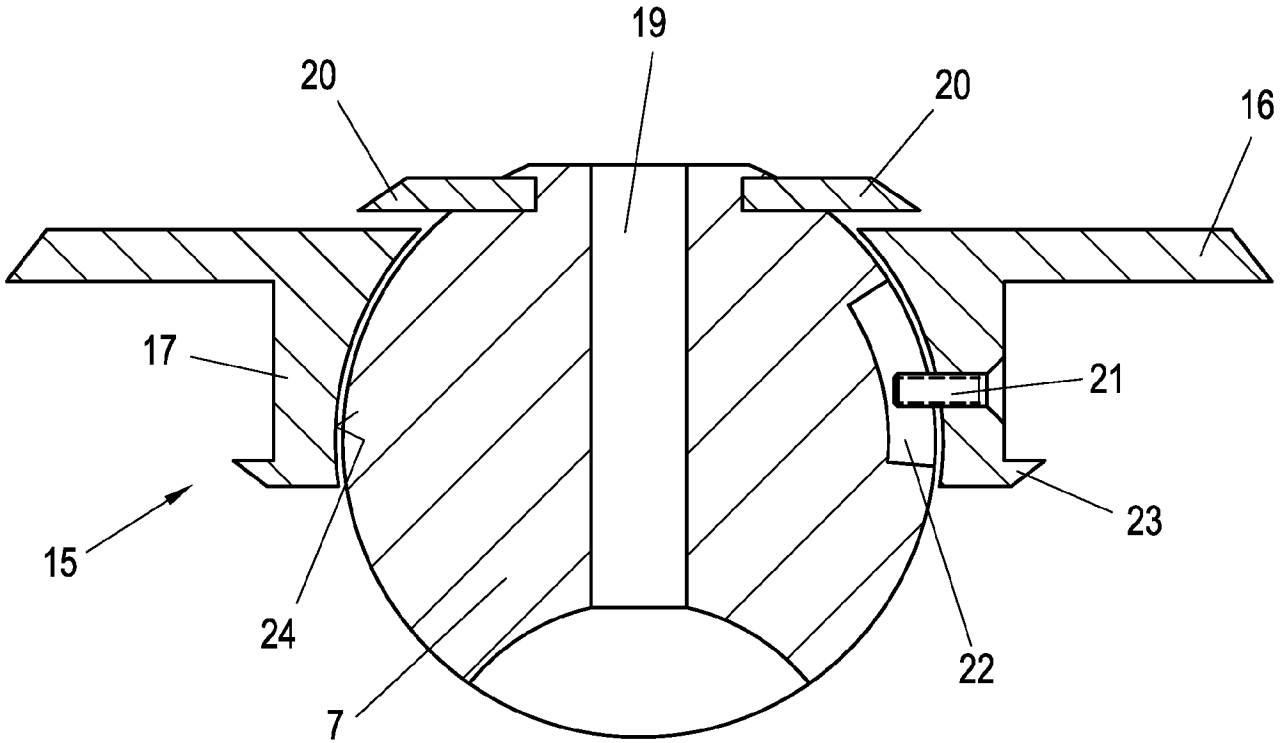
FIG. 3 shows a detail of the embodiment from FIG. 2 in a section on an enlarged scale.

In the embodiment of a grip 1 shown in FIG. 2, the ball 7 is held on the head 4 of the grip 1 using an insert 15. This insert 15 is shown in FIG. 3 in several details and is described below using FIG. 3.

The insert 15 that is made, for example, as a round, annular body has a flange 16 that rests on the edge of the recess 8 in the head 4 of the grip 1 and a ring body 17 that is made integral with the flange 16, or that is connected to it, and that projects into the recess 8 of the head 4. The ring body 17 in the illustrated exemplary embodiment bears a ring-shaped catch projection 23 or individual catch projections with which the insert 15 extends under a shoulder 18 in the recess 8 (FIG. 2) and fixes the insert 15 in the head 4 of the grip 1 by latching.

The insert 15 can be fixed by catching (latching) in the head 4 of the grip 1, not only as shown in FIG. 2. It is also possible to fasten the insert 15 in the head 4 of the grip 1 by cementing, by bonding, using attachment screws or else by the insert 15 being screwed into the recess 8 of the head 4 of the grip 1, for which on the outer surface of the ring body 17 of the insert 15 there is an outside thread, and on the inner surface of the recess 8 there is an inside thread.

The inner surface 24 of the insert 15, which surface is designed as a spherical ring surface, keeps the ball 7 able to turn and pivot in the insert 15. When the insert 15 is one piece, the ball 7 can be rusted into the insert 15, the insert 15 being transiently deformed elastically during the insertion of the ball 7.

To fasten the loop 5 to the ball 7, the screw 6 shown in FIG. 1 can also be used in the embodiment shown in FIG. 2.

For fastening of a loop 25 (or a loop 5), it is shown in FIG. 2 that the latter is inserted through a through hole 19 into the ball 7 and is held by a knot 26 or the like that lies on the ends of the through hole 19 that lie in the recess 8. It should be pointed out that the loop 25 shown in FIG. 2 can be either directly a loop 5 according to FIG. 1 or a longer loop 5 is attached to the loop 25 shown in FIG. 2.

FIG. 3 also shows measures for limiting the turning capacity (pivoting capacity) of the ball 7 relative to the insert 15 and thus relative to the grip 1.

These means are, on the one hand, stops 20 that are inserted into the ball 7, projecting over the outer surface of the ball 7, and that limit the pivoting region of the ball 7 relative to the insert 15 and thus relative to the grip 1 by striking the flange 16 of the insert 15.

Here, it is possible to provide several receiving openings for stops 20 in the ball 7 at different locations so that the pivoting region can be set (limited) to the desired value by choosing the location of the stops 20.

FIG. 3 also shows that the bulge of motion of the ball 7 can be limited by a projection, in the illustrated example by a pin 21 (for example, a screw) that has been inserted through the ring body 17 and whose end that projects over the inner surface of the ring body 17 as a projection engages a depression 22 in the ball 7. The choice of the size and shape of the depression 22 and of the pin 21 can limit the swiveling capacity and the turning capacity of the ball 7 to the desired region. Here, it is possible to define pivoting or turning regions of different size by depressions 22 of different size and/or shape in the ball 7.

The movements of the ball 7 will be limited by stops 20 and by a projection (pin 21) that engages the depression 22 of the ball 7, generally not both at the same time, but in alternation.

It goes without saying that the embodiment of a ball and socket joint shown in FIGS. 2 and 3 for fastening a loop 5 to a grip 1 is also possible in the embodiment of a grip 1 shown in FIG. 1. In particular, the grip 1 that is shown in FIG. 2 can be made like the grip 1 shown in FIG. 1 and vice versa.

Even if the invention has been explained above using the example of loops 5 or 25 attached to the grip 1 of a pole, it is preferred for the invention, but not critical, that the pole has a grip 1, of any shape and construction, to which the loop 5 or 25 is attached. Thus, the loop 5 or 25 according to the invention can be attached in an articulated manner, for example via a ball and socket joint with the embodiment shown in FIG. 1 or FIGS. 2 and 3, directly to poles at (largely) any locations, preferably in the grip region of poles.

In summary, one exemplary embodiment of the invention can be described as follows.

A loop 5 is fastened to a grip 1 of a pole using a ball and socket joint. The ball and socket joint encompasses a ball 7 that is held to be able to pivot and turn in a recess 8 in the head 4 of the grip 1.

The invention claimed is:

1. A pole with a grip and a loop
wherein the loop is attached in an articulated manner to the grip with a ball and socket joint,
wherein ends of the loop are held in a receiving hole in the ball, and
wherein the ball is held with the capacity to turn and pivot in an insert that is fixed in a head of the grip.

2. The pole according to claim 1, further comprising a stop that projects over an outer surface of the ball to limit a pivoting region of the ball.

3. The pole according to claim 1, further comprising a projection at the head of the grip that engages a depression in the ball.

4. The pole according to claim 3, wherein the depression is larger than a cross-sectional area of the projection.

5. The pole according to claim 3, wherein the projection is a pin that projects out of the insert into the depression.

6. The pole according to claim 1, wherein the ends of the loop are held in the receiving hole in the ball by a knot that lies on an end of the receiving hole.

7. A pole with a grip and a loop,
wherein the loop is attached in an articulated manner to the grip with a ball and socket joint, and
wherein the loop is attached to the ball in a region of a flattening of the ball, and
wherein the loop is attached to the ball using a screw that engages the ball.

8. The pole according to claim 7, wherein ends of the loop are attached overlapping one another to the ball.

9. The pole according to claim 7, further comprising a cover plate in which there is a hole whose diameter is smaller than that of the ball, and wherein side surfaces of the hole in the cover plate are conically tapering.

10. A grip for a sports pole, comprising:
a gripping element with an opening in a head thereof;
an insert in the opening of the head of the gripping element, the insert having a concave inner annular surface;
a ball that is attached to the insert, an exterior surface of the ball engaging the concave inner annular surface of the insert to hold the ball in the insert while permitting the ball to turn and pivot in the insert, the ball having a hole therein that is exposed to an exterior of the grip at the head of the gripping element; and
a loop with ends extending into the hole, the loop being secured to the ball and projecting from the head of the gripping element.

11. The grip according to claim 10, wherein the hole in the ball extends through the ball and wherein the ends of the loop extend through the ball into the opening in the head of the gripping element, the ends of the loop being secured to each other.

* * * * *